United States Patent [19]

Kindelberger et al.

[11] Patent Number: 5,060,790

[45] Date of Patent: Oct. 29, 1991

[54] HINGED BACK DISPLAY

[75] Inventors: Jack D. Kindelberger; Donald L. Baltzer, both of Navarre, Ohio

[73] Assignee: Vail Industries, Inc., Navarre, Ohio

[21] Appl. No.: 463,236

[22] Filed: Jan. 10, 1990

[51] Int. Cl.[5] ..... B65B 5/50; B65B 5/52

[52] U.S. Cl. ..... 206/45.11; 206/45.14

[58] Field of Search ..... 211/72, 73, 132, 133, 211/149, ; 206/44 R, 44.11, 45, 45.11, 45.14; 229/160.1, 101

[56] References Cited

U.S. PATENT DOCUMENTS

| | | | |
|---|---|---|---|
| R. 32,668 | 5/1988 | Smith | 211/149 |
| 1,850,020 | 3/1932 | Locke, Jr. | 206/45.25 |
| 2,075,919 | 4/1937 | Wagner et al. | 248/459 |
| 2,146,421 | 2/1939 | Davidson | 206/44 R |
| 2,891,710 | 6/1959 | Repking | 206/45.14 |
| 3,282,410 | 11/1966 | Cote | 206/45.14 |
| 3,360,118 | 12/1967 | Hanson et al. | 206/45.14 |
| 3,378,135 | 4/1968 | Stone | 206/45.14 |
| 4,197,939 | 4/1980 | Dogliotti | 206/44 R |
| 4,411,382 | 10/1983 | Taub | 206/45.25 X |
| 4,512,541 | 4/1985 | Lietzke | 248/459 |
| 4,579,220 | 4/1986 | Brundage | 206/45.25 |
| 4,595,093 | 6/1986 | Eckstein | 206/44 R |
| 4,641,746 | 2/1987 | Dornbusch et al. | 206/44 R |
| 4,651,871 | 3/1987 | Schroter | 206/44 R |
| 4,813,536 | 3/1989 | Willis | 206/44 R |

*Primary Examiner*—Paul T. Sewell
*Assistant Examiner*—Jacob K. Ackun, Jr.
*Attorney, Agent, or Firm*—Fay, Sharpe, Beall, Fagan, Minnich & McKee

[57] ABSTRACT

A display includes a bin and base disposed in angular or hinged back relation. The blank for constructing the display advantageously uses a hinge line in substantially colinear relation with first and second cut lines spaced from one another by a panel. First and second angular score lines extend from the colinear cut lines to permit a panel disposed between the angular score lines to fold therealong and bend along the hinge line.

24 Claims, 9 Drawing Sheets

HINGED BACK DISPLAY

BACKGROUND OF THE INVENTION

This invention pertains to the art of displays and more particularly to displays manufactured from corrugated materials and the like.

The invention is applicable to either a stand-up floor display or a countertop display in which a bin area is angularly disposed with respect to the floor. However, it will be appreciated that the invention has broader applications and may be advantageously employed in other display environments and applications.

Conventional displays suffer from a number of drawbacks, a majority of which can be tied to the complexity of the display and tedious and complicated setup required to assemble the display. In fact, display manufacturers are often forced to enclose instructions for assembly of the display in order to assure that the product is exhibited as desired. Otherwise, store owners faced with a prospect of (i) assembling the display versus (ii) placing the product on an existing counter and dispensing with the complicated display will choose the latter.

Still another problem associated with existing displays is the use of multiple parts or components. Frequently an inventory problem is encountered where a predetermined number of one display component is made while a different, predetermined number of another component is made. By forming a display from a single blank, this inventory problem is overcome. Unfortunately, the design options of a display are typically curtailed where the requirement of a single or unitary blank is imposed.

Related to the problem with multiple part displays is the savings that can be achieved through maximizing us of the entire blank. With two-piece displays, excessive amounts of material are removed from the blank and simply discarded. Accordingly, scrap removal and/or baling costs will be minimized if a display is manufactured from a single blank.

Another significant cost encountered with the two-piece displays is the need to provide at least two cutting dies. Each cutting die is costly from the standpoints of design, manufacture, and storage. Thus as is apparent, a substantial cost savings is realized if a one-piece display is manufactured as opposed to a multiple component assembly.

SUMMARY OF THE INVENTION

The present invention contemplates a new and improved display that overcomes all of the above referred to problems and others, that is simple and economical to manufacture, and less complicated to use.

According to the subject invention, the display includes a generally rectangular blank having a first set of parallel score lines dividing the sheet into four panels. A first set of cut lines extends substantially perpendicular to the score lines and at least two of the cut lines are substantially colinear. A hinge score line also extends substantially perpendicular to the first set of score lines and is substantially colinear to the first set of cut lines.

According to a further aspect of the invention, first and second angular score lines extend from the colinear cut lines.

According to yet another aspect of the invention, an H-shaped series of cut lines is disposed between the colinear cut lines.

According to an alternate aspect of the invention, a U-shaped series of cut lines is disposed between the colinear cut lines.

According to the method of forming a display, a generally rectangular blank is provided and scored to define four panel portions. The blank is cut to define generally colinear first and second cut lines. The blank is also scored to define first and second angular fold lines that intersect the cut lines. An additional scoring of the blank defines a hinge line along an area substantially colinear with the first and second cut lines. The blank is folded along the score lines to define four sidewalls in the container. The blank is further folded along the angular fold lines and hinge line to tilt one portion of the container relative to another.

A principal advantage of the invention is the economical manufacture of an angular display that is simple to assemble.

Another advantage of the invention resides in the variety of designs available based on the concepts of this invention.

Yet another advantage of the invention is found in the maximization of blank material use during manufacture of the display.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred and alternate embodiments, and methods of assembling, of which will be described in detail in the specification and illustrated in the accompanying drawings which form a part hereof, and wherein.

DETAILED DESCRIPTION OF THE PREFERRED EMBODIMENTS AND METHOD

Figure 1:
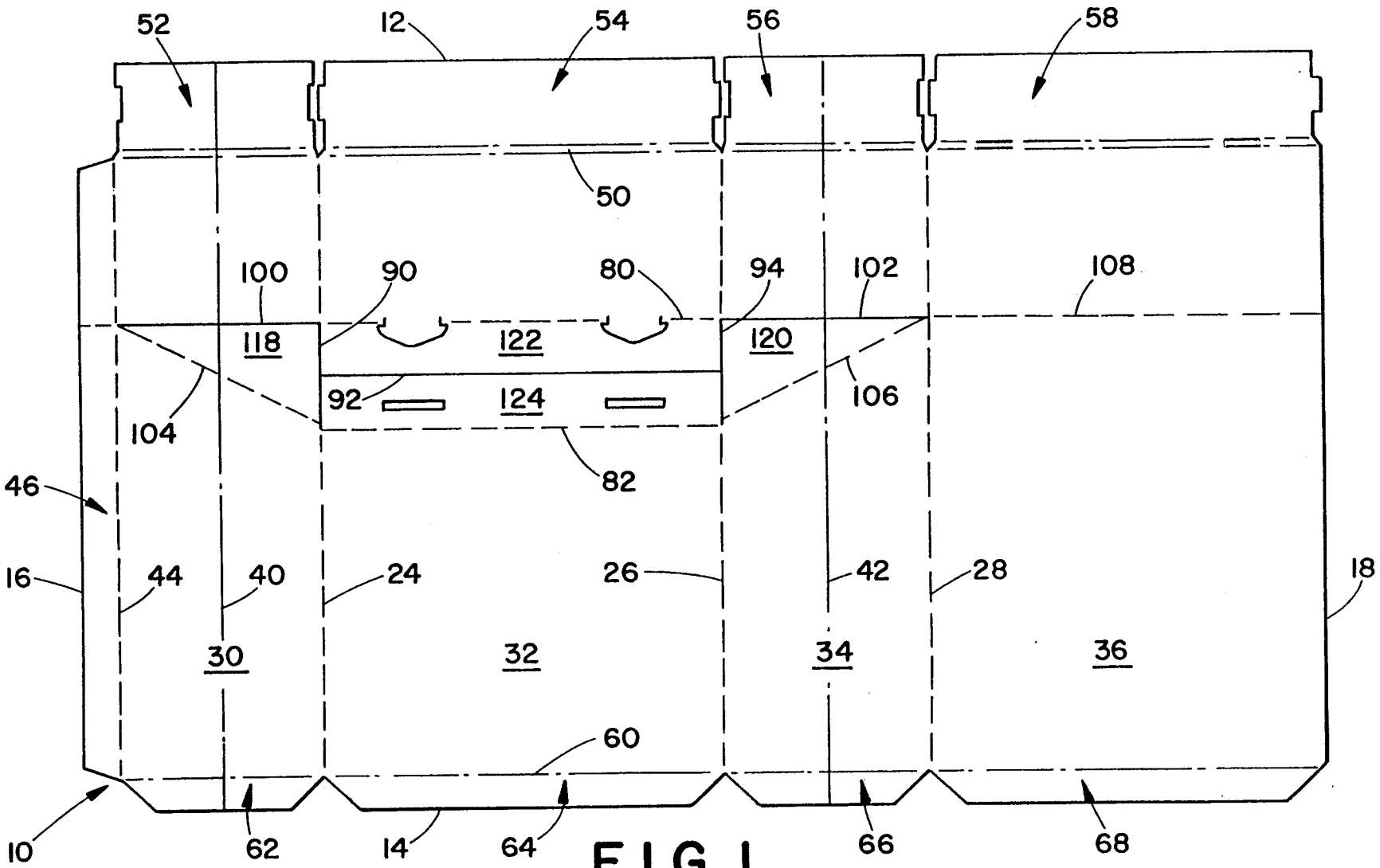
FIG. 1 is a plan view of a preferred blank after scoring and cutting, but prior to folding and assembly.

Referring now to the drawings wherein the showings are for purposes of illustrating the preferred embodiments and method of assembling the invention only and not for purposes of limiting same, the FIGURES show three preferred embodiments of a display A, A', and A''. Each of the displays is defined by two major portions, a bin B and a base or stand C. A product or consumer good is adapted for receipt in the bin area of a display.

More particularly, and with reference to FIGS. 1–4, a first preferred embodiment of the display is shown as a scored and cut blank, and after assembly into a display. The display A is formed from a blank or sheet of material 10 that has a generally rectangular configuration. For purposes of coordinating the following discussion, selected terms such as "upper" and "lower" and "vertical" and "horizontal" will be utilized, although it will be understood that the blank can be oriented in a variety of manners without departing from the scope and intent of the subject invention. A first or upper edge 12 is spaced from a second or lower edge 14 by first and second side edges 16, 18.

The blank is typically a corrugated material such as cardboard, paper, or the like that has a predetermined score and cut pattern that permits maximized use of the material. Specifically, a first series of longitudinal or vertical score lines (illustrated by dashed lines) is defined by first score line 24, second score line 26, and third score line 28. These score lines divide the blank into respective first, second, third, and fourth portions 30, 32, 34, 36. As illustrated, the first and third portions 30, 34 are of substantially the same width while the second and fourth portions 32, 36 are likewise of substantially the same width, even though slightly wider than the first and third portions. Obviously, this arrangement, and as will become apparent below, provides a generally symmetrical display structure in which the sides are of substantially the same width, and the front and back of the assembled display also have substantially the same lateral dimension.

Additional vertical score lines 40, 42 generally bisect the first and third portions 30, 34, respectively. These vertical score lines are optional and provide inward flexing of portions 30, 34 defining the sidewalls in the final assembled structure to facilitate collapsing and shipping of the display. Yet another vertical score line 44 is defined adjacent the first side edge 16 to define a longitudinal tab 46. The tab is secured by suitable means such as an adhesive or the like to fourth portion 36 adjacent the side edge 18.

A first or upper horizontal score line 50 (or pair of score lines) defines a series of tabs 52, 54, 56, 58 that eventually define the perimeter of the bin B of the assembled display. In a similar manner, a second or lower horizontal score line 60 defines tabs 62, 64, 66, 68 that are folded inwardly along the score line 60 to facilitate support of the base C of the display.

With particular reference to the second portion 32 of the blank, horizontal score lines 80 and 82 are provided. Additionally, a generally U-shaped or H-shaped series of cut lines (shown by solid lines) is defined by individual cut lines 90, 92, 94. The cut line 92 permits that portion of panel 32 above it, i.e., between cut line 92 and score line 80 to move freely relative to that portion below cut line 92, i.e., between cut line 92 and score line 82. The U-shaped series of cut lines can refer to either the upper or lower portions of the H-shaped series of cut lines.

More importantly, colinear cut lines 100, 102 are provided in the first and third panel portions 30, 34, respectively. One end of each of the colinear cut lines intersects one of the vertical cut lines 90, 94 of the H-shaped series. Further, angular score lines 104, 106 extend from the opposite terminal ends of the cut lines 100, 102, respectively, to the distal end of vertical cut lines 90, 94. The angular score line 104 and cut lines 90, 100 define a triangular portion 118. Likewise, the angular score line 106 and the cut lines 94, 102 define a triangular portion 120.

In conjunction with score line 108 provided in the fourth portion 36 of the blank, the H-shaped cut lines, colinear cut lines, and angular score lines provide a tilt or hinged back arrangement in panel 32. Specifically, the score line 108 defines a hinge that permits selective tilting or angling of the bin relative to the base as will become more apparent below.

Figure 2:
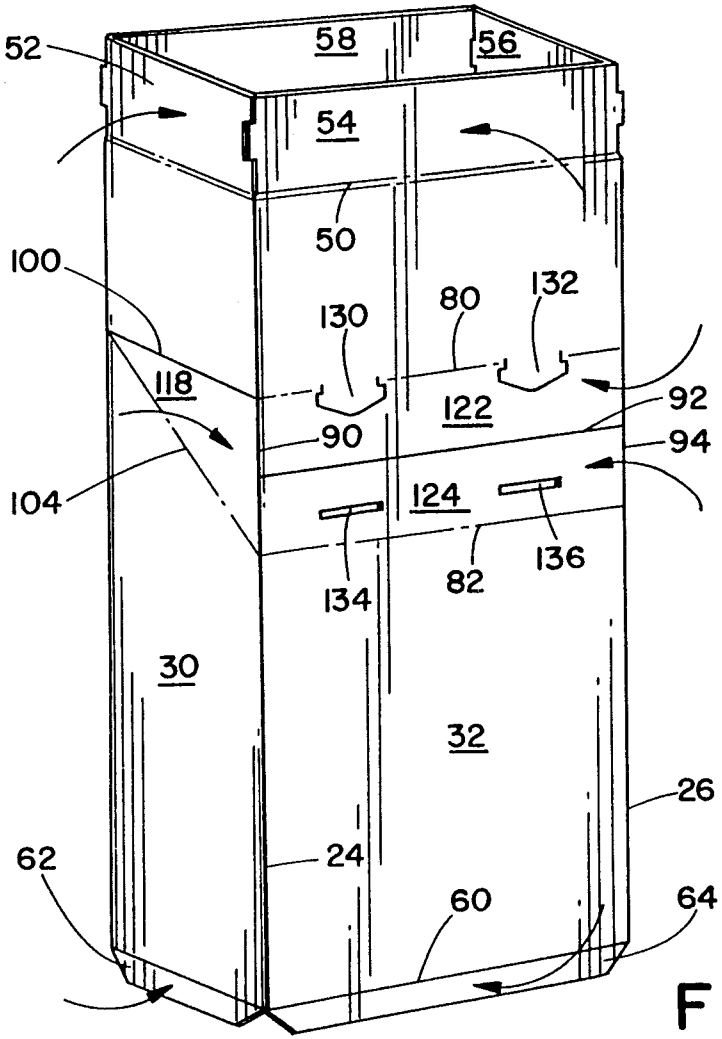
FIG. 2 illustrates intermediate steps of assembling the blank of FIG. 1 into a display.

With additional reference to FIG. 2, the blank has been partially assembled into an open ended, generally elongated cubical form. This is achieved by folding the blank along score lines 24, 26, 28 and securing the longitudinal tab 46 along the side edge 18 of the blank. In this manner, first and third portions 30, 34 define sidewalls while portions 32, 36 define front and rear walls, respectively. Upper tabs 52, 54, 56, 58 are folded inwardly along score line 50 (as depicted by the arrows) into the interior cavity defined by the partially assembled display. Likewise, tabs 62, 64, 66, 68 are folded along score line 60 (also as depicted by the arrows).

Triangular portions 118, 120 are defined in the sidewalls 30, 34. As illustrated by the arrows in FIG. 2, these triangular portions are folded inwardly along the angular score lines into the interior cavity of the partially assembled display.

Figure 3:
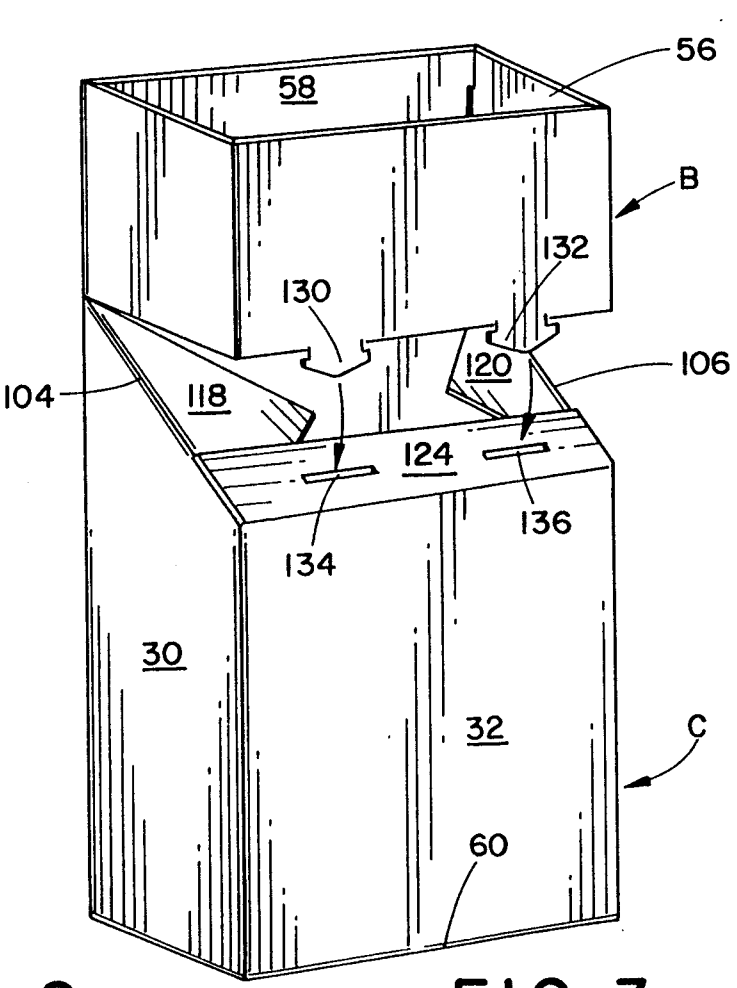
FIG. 3 illustrates further steps in assembling the blank of FIG. 1 into a display.
Figure 4B:
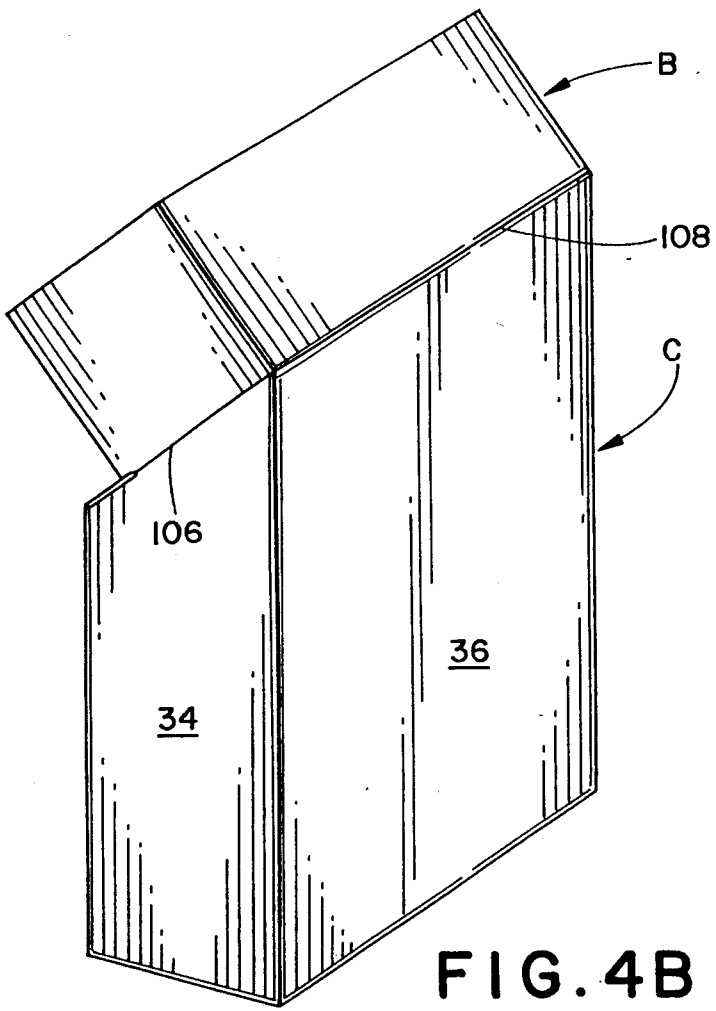
FIG. 4B is a rear perspective view from the left-hand side of the completed display assembled from the blank of FIG. 1.
Figure 4A:
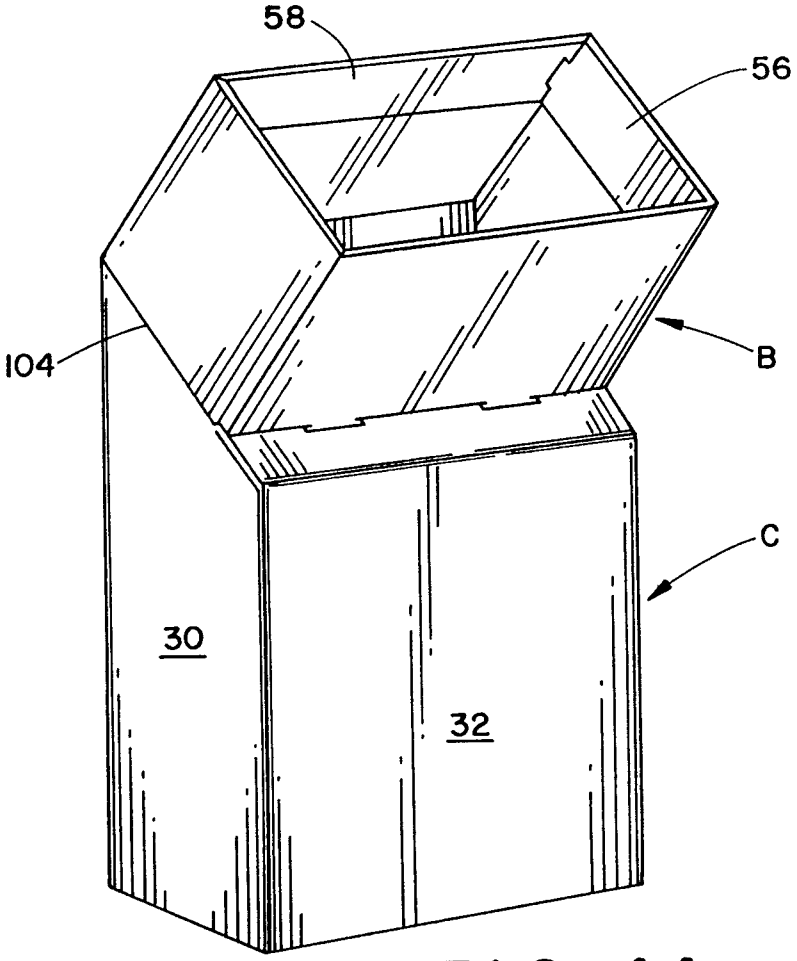
FIG. 4A is a front perspective view from the left-hand side of the completed display assembled from the blank of FIG. 1.

A first rectangular portion 122 is defined by vertical cut lines 90, 94, horizontal cut line 92, and score line 80. Likewise, rectangular portion 124 is defined by cut lines 90, 92, 94 and horizontal score line 82. Each of these rectangular portions is folded inwardly into the interior cavity of the partially assembled display as illustrated by the arrows in FIG. 2 along their respective horizontal score lines. Locking tabs 130, 132 are selectively received in openings 134, 136 when the upper or bin portion B is hinged along hinge score line 108. Thus as illustrated in FIGS. 3, 4A and 4B, the bin B is angularly disposed relative to the base C. The bin B is thereby adapted to exhibit a product (not shown) in an angular fashion relative to the tabletop or floor surface in an aesthetically pleasing manner.

Figure 5:
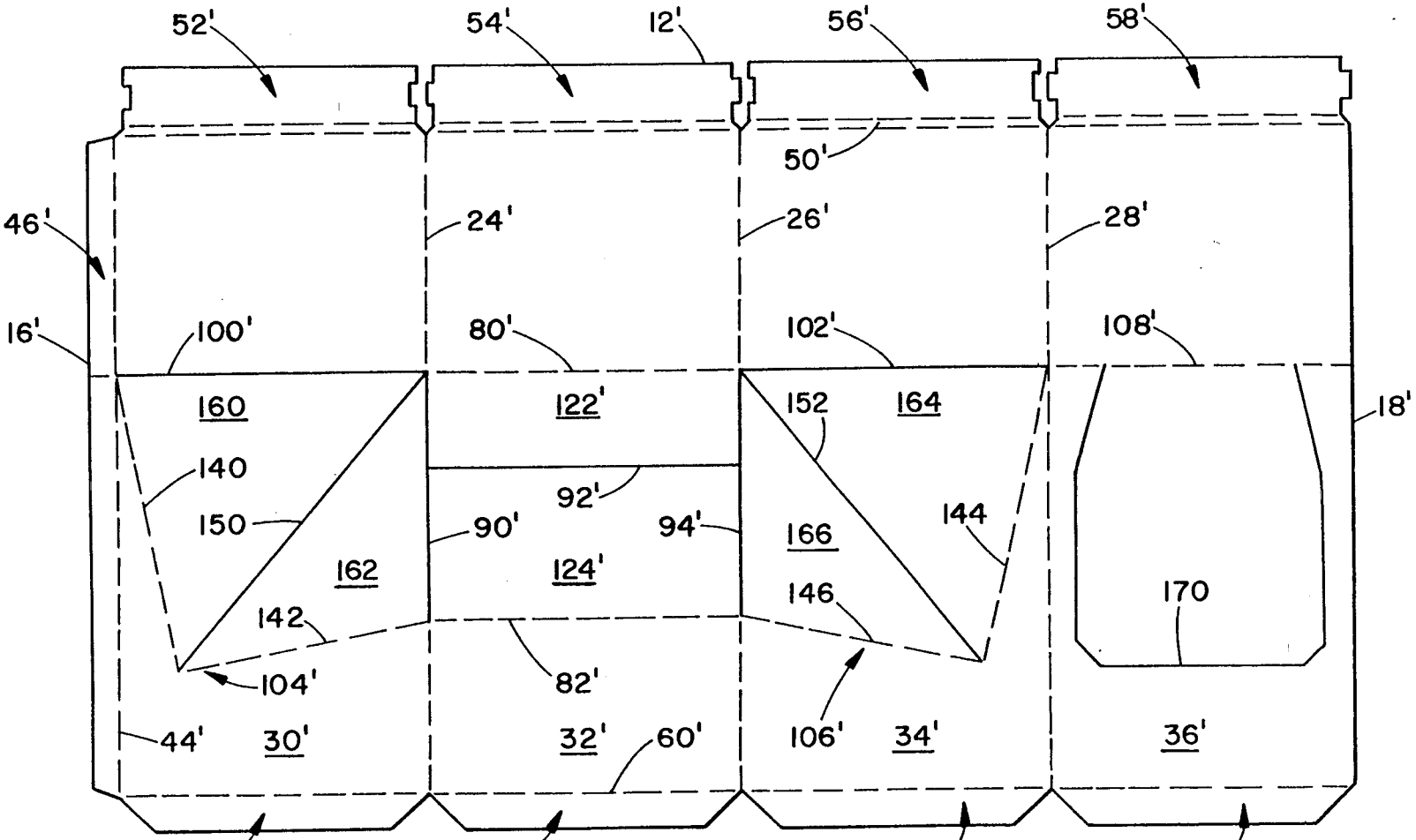
FIG. 5 is a plan view of an alternate blank after scoring and cutting, but prior to folding and assembly.
Figure 6:
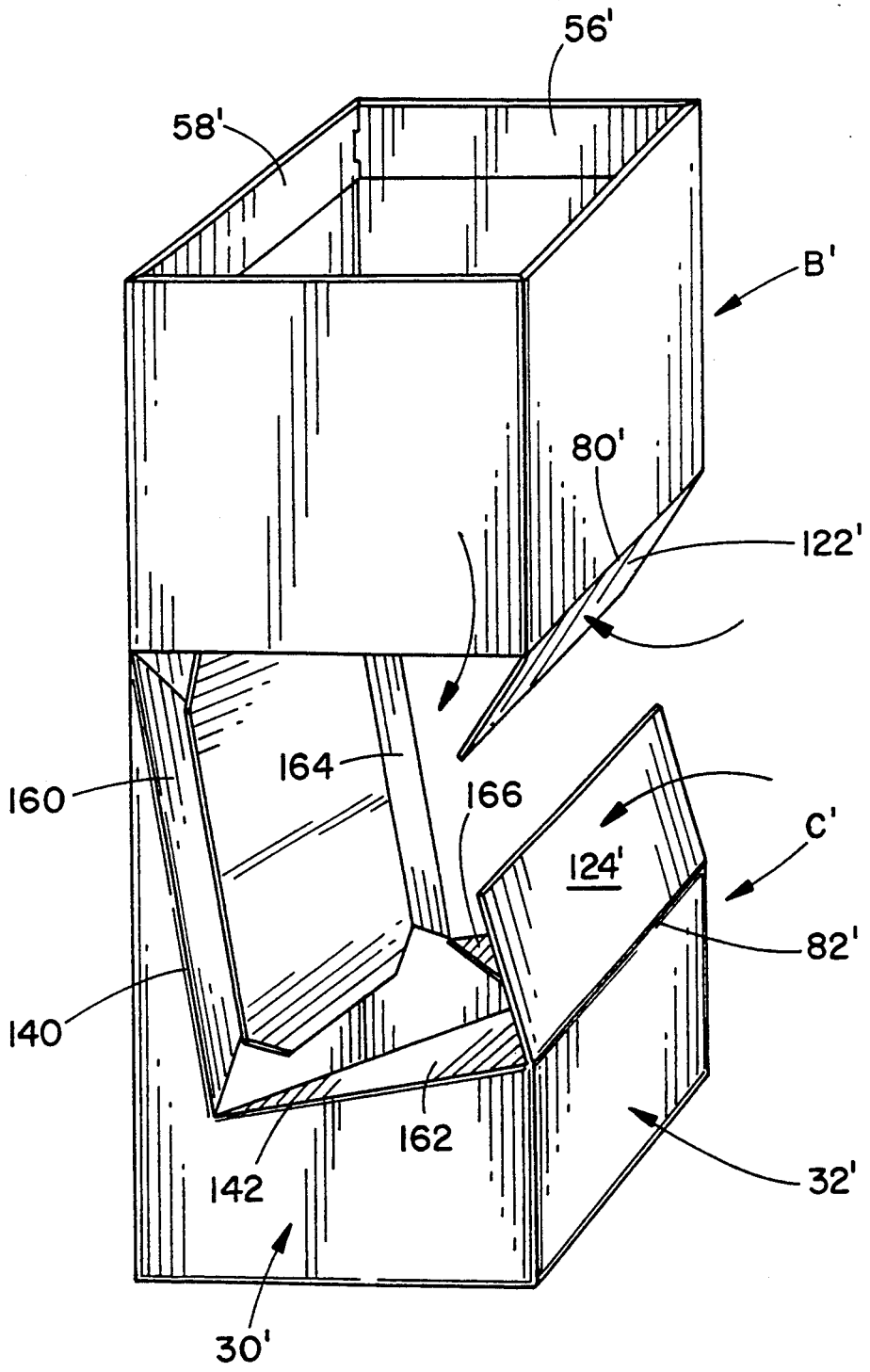
FIG. 6 illustrates intermediate steps in assembling the blank of FIG. 5 into a display.
Figure 7B:
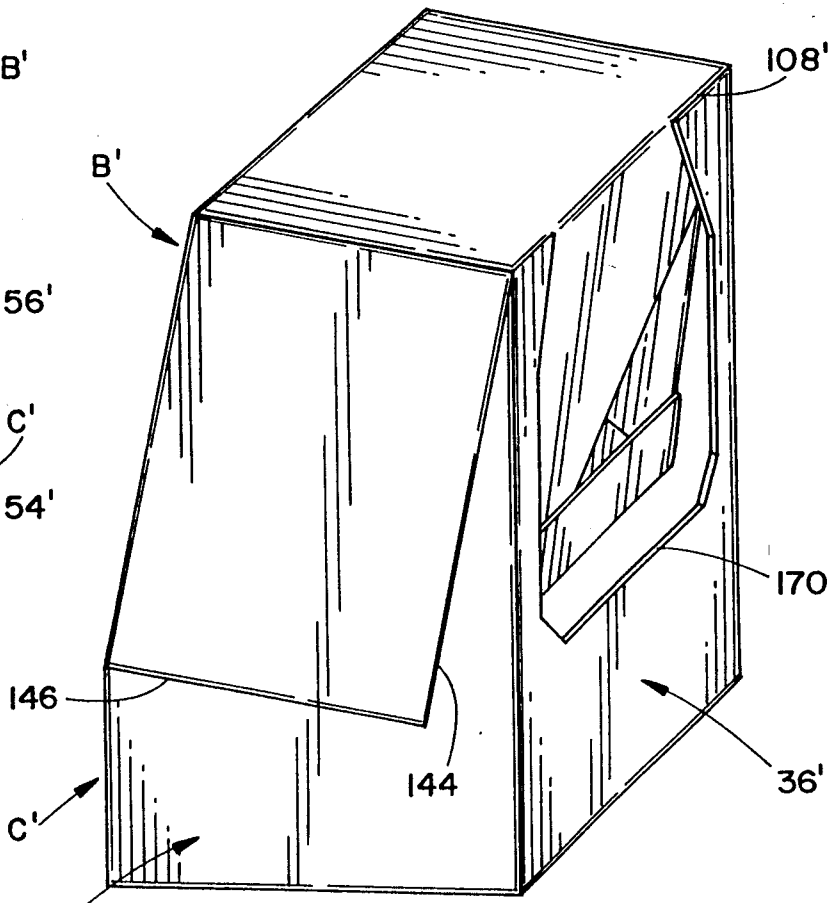
FIG. 7B is a rear perspective view from the left-hand side of the completed display assembled from the blank of FIG. 5.
Figure 7A:
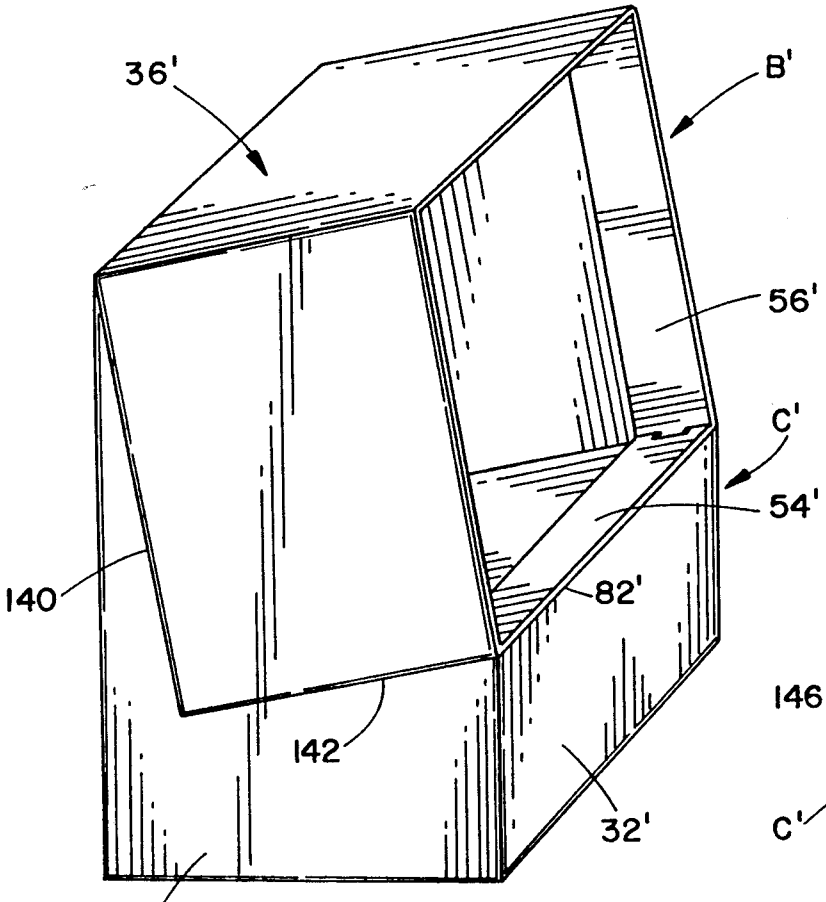
FIG. 7A is a front perspective view from the left-hand side of the completed display assembled from the blank of FIG. 5.
Figure 8:
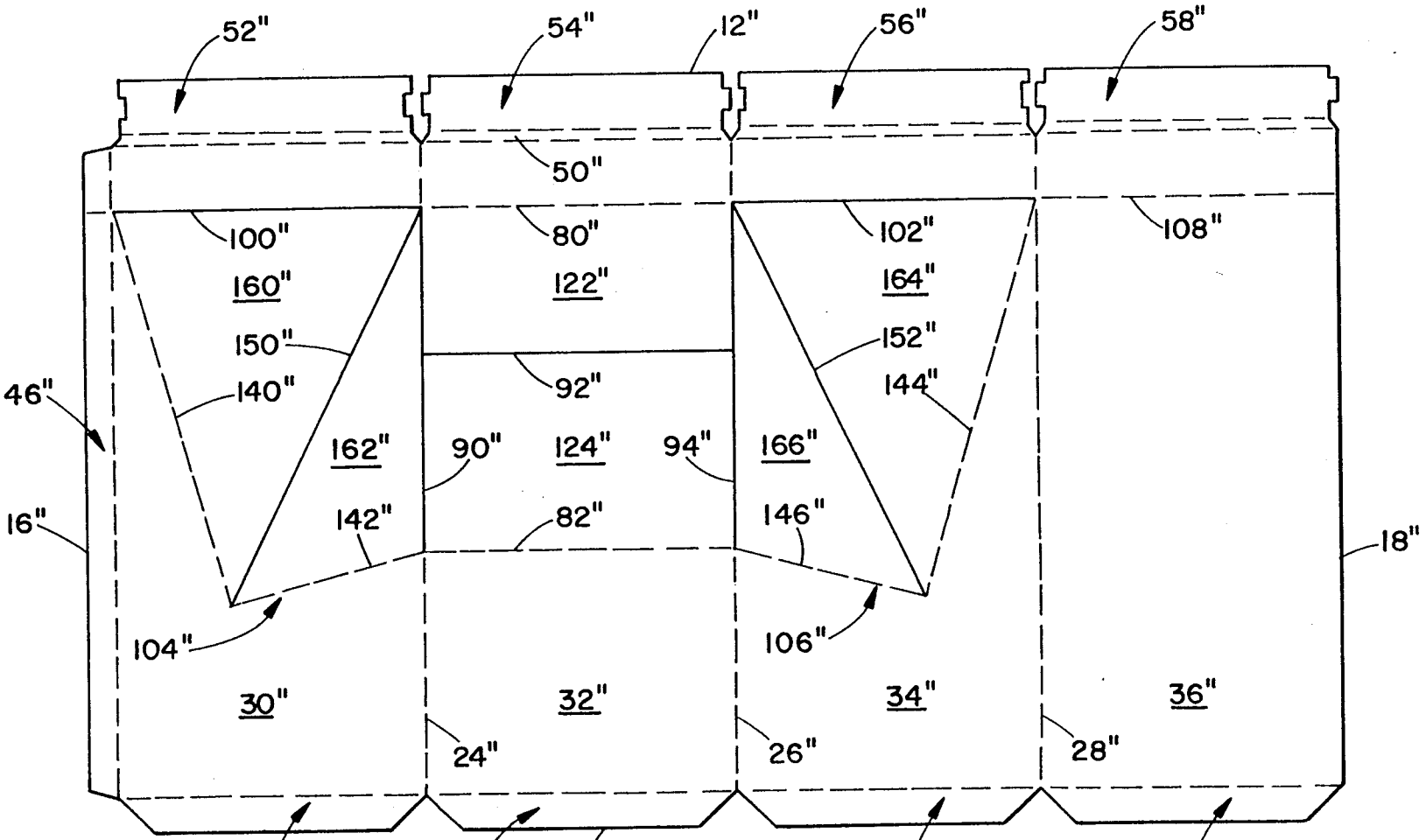
FIG. 8 is a plan view of a second alternate blank after scoring and cutting, but prior to folding and assembly.
Figure 9:
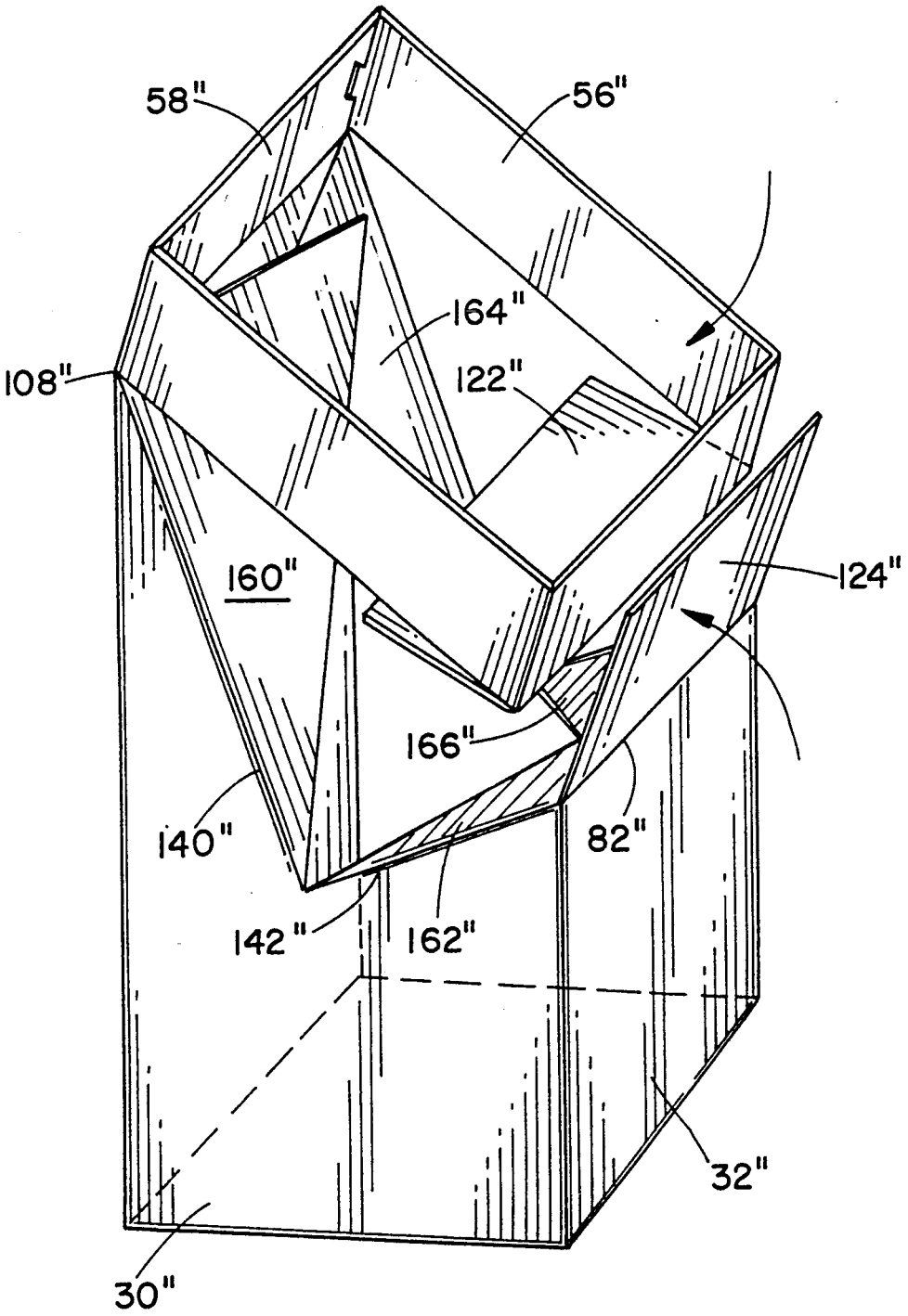
FIG. 9 illustrates the intermediate steps of assembling the blank of FIG. 8 into a display.
Figure 10B:
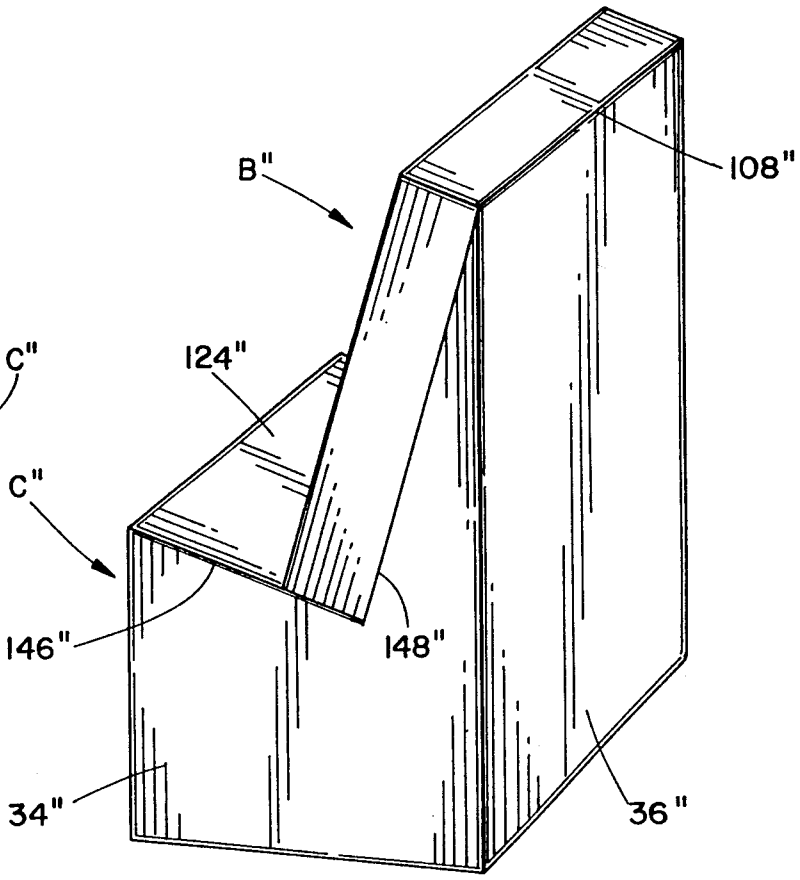
FIG. 10B is a rear perspective view from the left-hand side of the completed display assembled from the blank of FIG. 8.
Figure 10A:
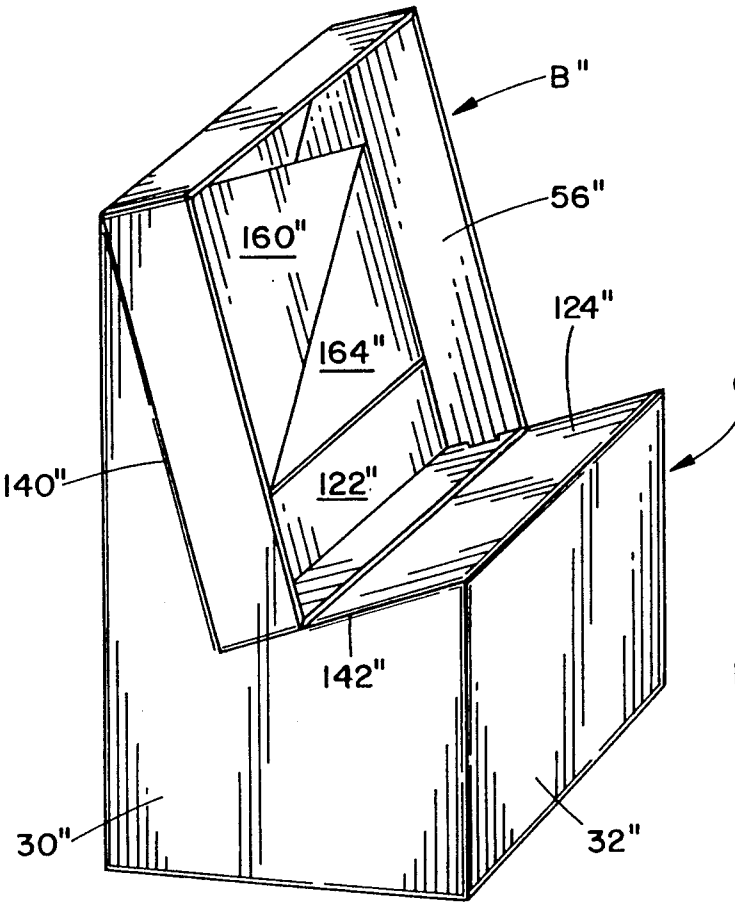
FIG. 10A is a front perspective view from the left-hand side of the completed display assembled from the blank of FIG. 8.

Turning now to FIGS. 5–7, a second preferred embodiment will be described in detail. For ease of reference and to facilitate an understanding thereof, like numerals will refer to like elements with a primed suffix (') while new numerals will be used to define new elements. A blank 10' has upper and lower edges 12', 14' and side edges 16', 18'. Score lines 24', 26', 28' divide the blank into four generally equal panel portions 30', 32', 34', 36'. An upper horizontal score line 50' defines tabs 52', 54', 56', 58'. Likewise, lower horizontal score line 60' defines tabs 62', 64', 66', 68'. Additionally, the further vertical score line 44' defines a longitudinal tab 46'that is secured during assembly to the fourth panel adjacent the edge 18'. The horizontal cut lines 100' and 102' are again generally defined in the first and third panels. An H-shaped series of cut lines is also defined in the second panel by cut lines 90', 92', 94'. Additional horizontal score lines 80' and 108' facilitate formation of the bin relative to the base C'. Comparison of FIG. 5 with FIG. 1 also illustrates that the area of the blank that defines the bin is more closely equal to that of the blank area defining the base in the FIG. 5 embodiment.

A first major area of distinction in the FIG. 5 embodiment is the modification to the angular score lines 104', 106'. Although the angular score line 104' extends from one end of cut line 100' to one end of cut line 90', it does not extend in a linear fashion as in the FIG. 1 embodiment. Instead it is defined by two score line portions 140, 142. Similarly, angular score line 106' includes portions 144, 146. An angular cut line 150 intersects cut lines 100', 90' at one end and score line portions 140, 142 at the other end. In like fashion, angular cut line 152 intersects cut lines 94', 102' at one end and intersects angular score line portions 144, 146 at the other end. This arrangement defines four triangular portions 160, 162, 164, 166.

With particular reference to the fourth panel portion 36', an oblong cut line 170 is adapted to hinge about score line 108' so that the triangular portions are received beneath it as illustrated in FIG. 6. Triangular portions 162, 166, are folded along their score lines 142, 146 into the cavity of the partially assembled display. Additionally, triangular portions 160, 164 are folded along angular score line portions 140, 144. The rectangular portions 122', 124' are folded along score lines 80' and 82' so that the bin portion B' may be folded along score line 108' and define an angular or hinge back display.

The second preferred embodiment illustrated in FIGS. 8–11 demonstrates the relative dimensioning and variety of hinge back displays that result from varying the position of the colinear cut line and hinge score line. Again, and for ease of discussion and reference, like numerals with a double primed suffix (") will be used to identify like elements while new numerals will identify new elements. According to this arrangement, the colinear cut lines 100", 102" along with horizontal score line 80" and hinge score line 108" are disposed much more closely to upper edge 12" than the lower edge 14". As is apparent in FIGS. 9 and 10, this results in a bin B" having a very shallow depth. Additionally, rectangular portion 124" defines a shelf that is available to provide additional support for the product to be displayed. The oblong cut line 170 has also been eliminated from the FIG. 8 embodiment. In all other respects, the second preferred embodiment is substantially the same and assembled in substantially the same manner as the embodiment of FIGS. 5–7.

The invention has been described with reference to the preferred embodiments. Obviously modifications and alterations will occur to others upon a reading and understanding of the specification. It is intended to include all such modifications and alterations insofar as they come within the scope of the appended claims or the equivalents thereof.

Having thus described the invention, it is now claimed:

1. A display comprising:

a generally rectangular blank;

a first set of generally parallel score lines dividing the blank into four panels;

a first set of cut lines extending substantially perpendicular to said first set of score lines, at least two cut lines being substantially colinear and being spaced from one another by a panel;

first and second angular score lines extending from the colinear cut lines, respectively; and, a hinge score line extending substantially perpendicular to said first set of score lines and being substantially colinear to the said first set of cut lines, said hinge score line being disposed in a panel adjacent a panel containing one of the two colinear cut lines.

2. The display as defined in claim 1 further comprising an H-shaped series of cut lines disposed between the colinear cut lines.

3. The display as defined in claim 1 further comprising a U-shaped series of cut lines disposed between the colinear cut lines.

4. The display as defined in claim 1 further comprising a U-shaped series of cut lines disposed between the colinear cut lines, and first and second angular score lines extending between the colinear cut lines and the U-shaped cut lines.

5. A blank for forming a display container, the blank comprising:

a generally rectangular sheet;

a first series of longitudinal score lines dividing the sheet into first, second, third and fourth panels where the first and third panels are spaced apart by only the second panel;

a first lateral cut line in the first panel;

a second lateral cut line in the third panel;

first and second longitudinal cut lines, a first end of the first longitudinal cut line intersecting a first end of the first lateral cut line, and a first end of the second longitudinal cut line intersecting a first end of the second lateral cut line; and a hinge score line defined in the fourth panel, the hinge score line being substantially colinear with the first and second lateral cut lines.

6. The blank as defined claim 5 further comprising first and second angular score lines, the first angular score line extending between a second end of the first longitudinal cut line and a second end of the first lateral cut line, and the second angular score line extending between a second end of the second longitudinal cut line and a second end of the second lateral cut line.

7. The blank as defined in claim 5 further comprising a third lateral cut line disposed in the second panel and interconnecting the first and second longitudinal cut lines.

8. The blank as defined in claim 7 wherein the third lateral cut line is longitudinally offset from the first and second lateral cut lines.

9. The blank as defined in claim 7 wherein the third lateral cut line defines a generally H-shaped configuration with the first and second longitudinal cut lines.

10. The blank as defined in claim 7 wherein the third lateral cut line defines a generally U-shaped configuration with the first and second longitudinal cut lines.

11. A blank for forming a display container, the blank comprising a generally rectangular member;

first, second, and third longitudinal score lines dividing the member into first, second, third and fourth panels;

first and second lateral cut lines defined in the first and third panels;

a lateral score line defined in the fourth panel, the lateral score line being substantially colinear with the first and second lateral cut lines;

first and second longitudinal cut lines, a first end of the first longitudinal cut line intersecting a first end of the first lateral cut line, and a first end of the second longitudinal cut line intersecting a first end of the second lateral cut line;

first and second angular score lines, a first end of the first angular score line intersecting a second end of the first longitudinal cut line, a second end of the first angular score line intersecting a second end of the first lateral cut line, a first end of the second angular score line intersecting a second end of the second longitudinal cut line, and a second end of the second angular score line intersecting a second end of the second lateral cut line; and a third lateral cut line interconnecting the first and second longitudinal cut lines.

12. The blank as defined in claim 11 wherein the third lateral cut line defines a generally U-shaped configuration with the first and second longitudinal cut lines.

13. The blank as defined in claim 11 wherein the third lateral cut line defines a generally H-shaped configuration with the first and second longitudinal cut lines.

14. A blank for forming a display container, the blank comprising:

a generally rectangular member;

first, second, and third longitudinal score lines dividing the member into first, second, third, and fourth panels;

a first generally lateral cut line extending across the second panel;

first and second longitudinal cut line substantially colinear with the first and second longitudinal score lines and respectively intersecting opposite ends of the lateral cut line; and a hinge score line extending substantially perpendicular to the third longitudinal score line and being disposed in the fourth panel.

15. The blank as defined in claim 14 wherein the fourth panel is spaced from the second panel by the third panel.

16. The blank as defined in claim 14 further comprising second and third cut lines in the first and third panels, respectively, a first end of the second cut line intersecting the first longitudinal cut line, and a first end of the third cut line intersecting the second longitudinal cut line.

17. The blank as defined in claim 16 wherein the second cut line intersects a first end of the first longitudinal cut line.

18. The blank as defined in claim 17 wherein the third cut line intersects a first end of the second longitudinal cut line.

19. The blank as defined in claim 16 further comprising first and second angular score lines-defined in the first and third panels, respectfully.

20. The blank as defined in claim 19 wherein the first angular score line intersects a second end of the second cut line.

21. The blank as defined in claim 20 wherein the second angular score line intersects a second end of the third cut line.

22. The blank as defined in claim 21 wherein the first and second angular score lines intersect the first and second longitudinal cut lines, respectfully.

23. The blank as defined in claim 14 further comprising a lateral score line in the second panel that is spaced from the first lateral cut line.

24. The blank as defined in claim 23 wherein the lateral score line is colinear with the hinge score line.

* * * * *